US005456826A

United States Patent [19]

Mellegård

[11] Patent Number: 5,456,826

[45] Date of Patent: Oct. 10, 1995

[54] SEPARATING GRID

[75] Inventor: Per Mellegård, Mariestad, Sweden

[73] Assignee: Mellegard VA-Maskiner AB, Mariestad, Sweden

[21] Appl. No.: 150,153

[22] Filed: Dec. 13, 1993

[30] Foreign Application Priority Data

May 29, 1991 [SE] Sweden ..... 9101663

[51] Int. Cl.[6] ..... B01D 33/00

[52] U.S. Cl. ..... 210/155; 210/158; 210/162

[58] Field of Search ..... 198/773, 774.1, 198/776; 210/154, 155, 156, 158, 159, 161, 162, 357, 359

[56] References Cited

U.S. PATENT DOCUMENTS

| | | | |
|---|---|---|---|
| 4,853,116 | 8/1989 | Wallander et al. | 210/155 |
| 5,032,262 | 7/1991 | Wallander | 210/155 |
| 5,059,313 | 10/1991 | Etschel et al. | 210/155 |
| 5,098,561 | 3/1992 | Grabbe | 210/159 |

FOREIGN PATENT DOCUMENTS

| | | |
|---|---|---|
| 436416 | 12/1984 | Sweden . |
| 448106 | 1/1987 | Sweden . |
| 458862 | 5/1989 | Sweden . |

*Primary Examiner*—Peter A. Hruskoci
*Attorney, Agent, or Firm*—Bucknam and Archer

[57] ABSTRACT

A separating grid (1) for collection and removal of solid particles and objects (4) from running water (2) in a channel (2). The separating grid (1) comprises a stand (9) including a separating unit (10) formed by separating grid bars (11, 12) positioned side by side in such a manner that fixed grid bars (11) alternate with mobile grid bars (12), said grid bars formed with collection and removal means (13). The fixed grid bars (11) are securely attached to the stand whereas the mobile grid bars (12) are connected at their upper ends (17) to a drive unit (18) and at their lower ends (16) they are arranged for controlled movement in the stand. The drive unit imparts to the mobile grid bars a movement which at the upper end of the bars follows a closed path but in a direction towards their lower ends follows successively and increasingly flattened, elliptical paths changing at the lower ends into an essentially rectilinear to-and-fro movement path. According to this arrangement, the mobile grid bars carry, by means of their collection and removal means, the objects step by step upwards along the collection and removal means of the fixed grid bars, up to a discharge (19) for removal.

10 Claims, 5 Drawing Sheets

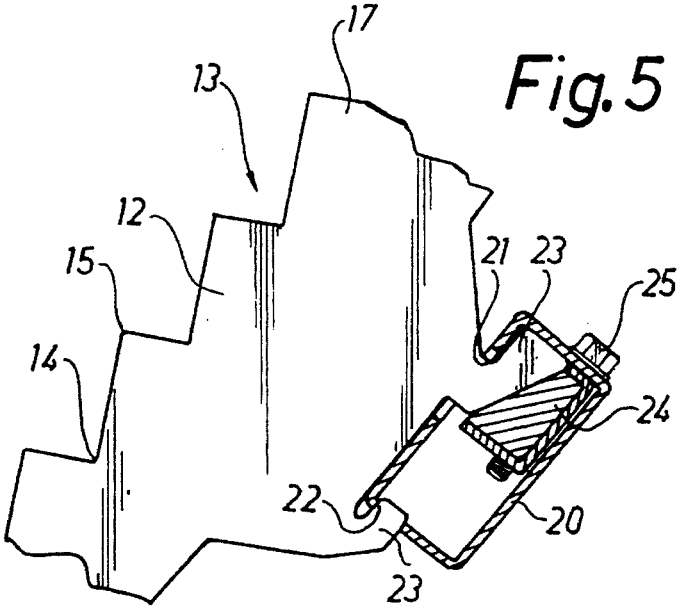
Fig. 5
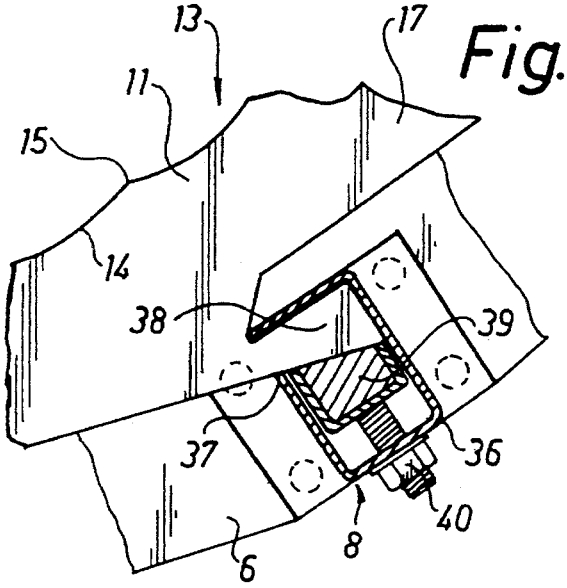
Fig. 4
Fig. 3
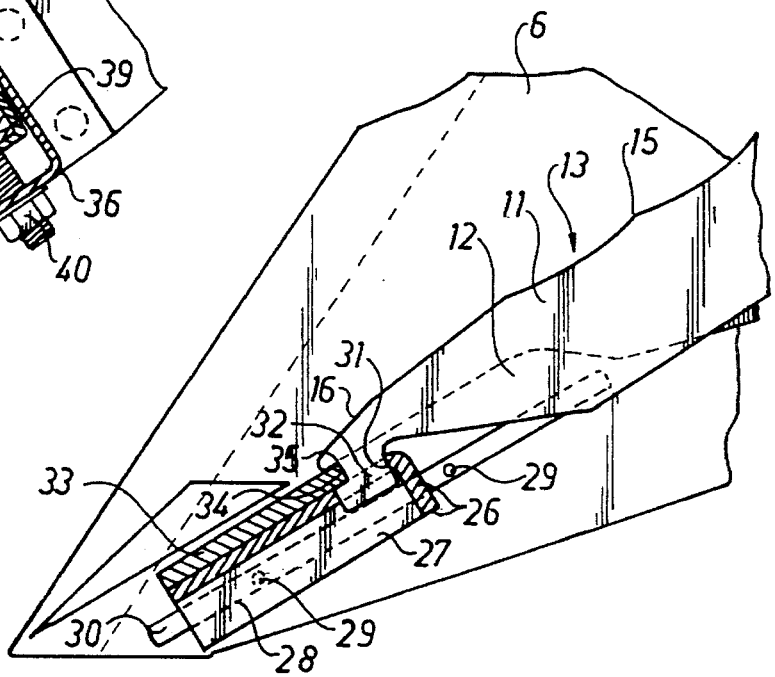

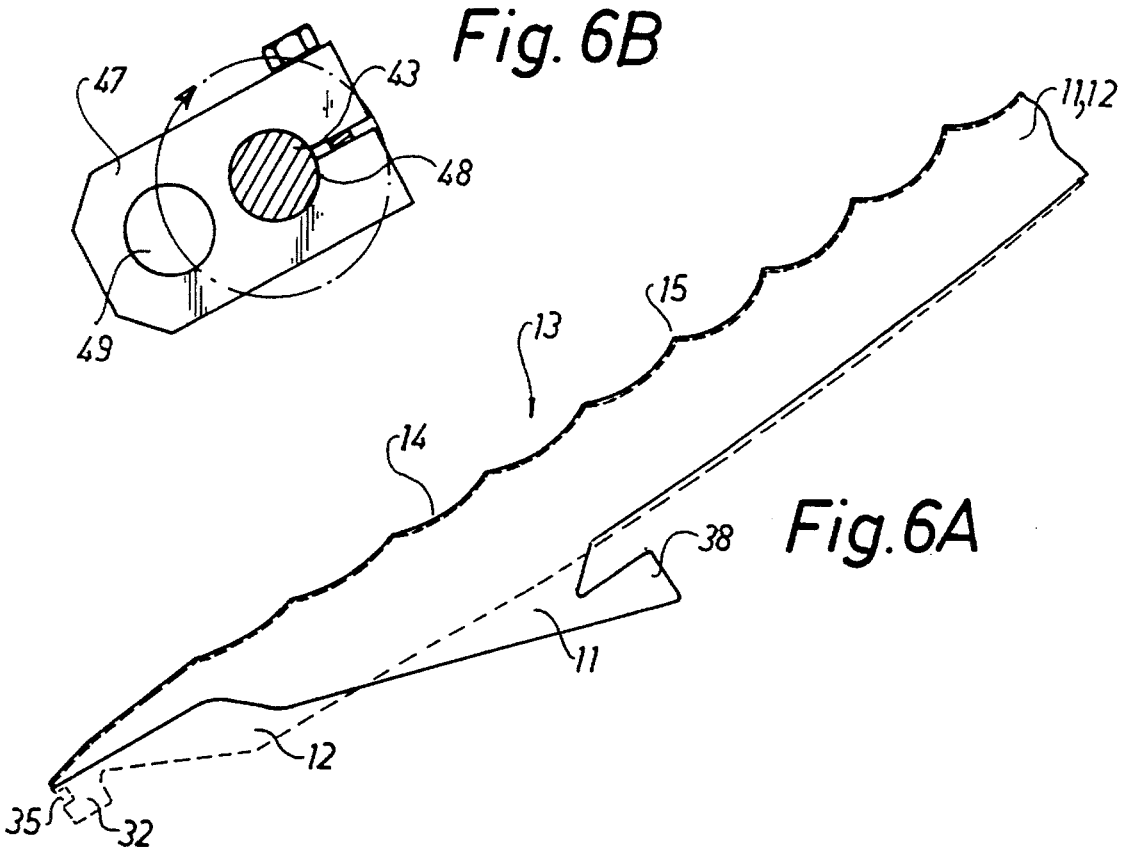
Fig. 6B
47
43
48
49
11,12
15
13
14
38
Fig.6A
11
12
35
32
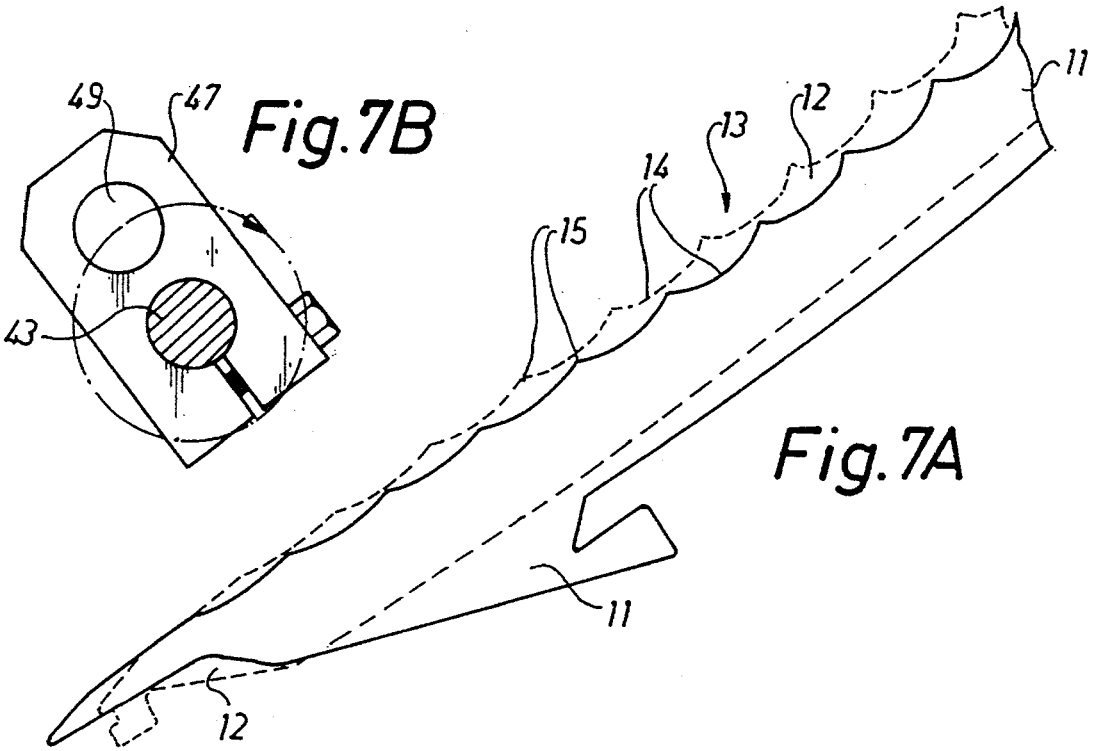
49
47
Fig.7B
43
11
12
13
14
15
Fig.7A
11
12

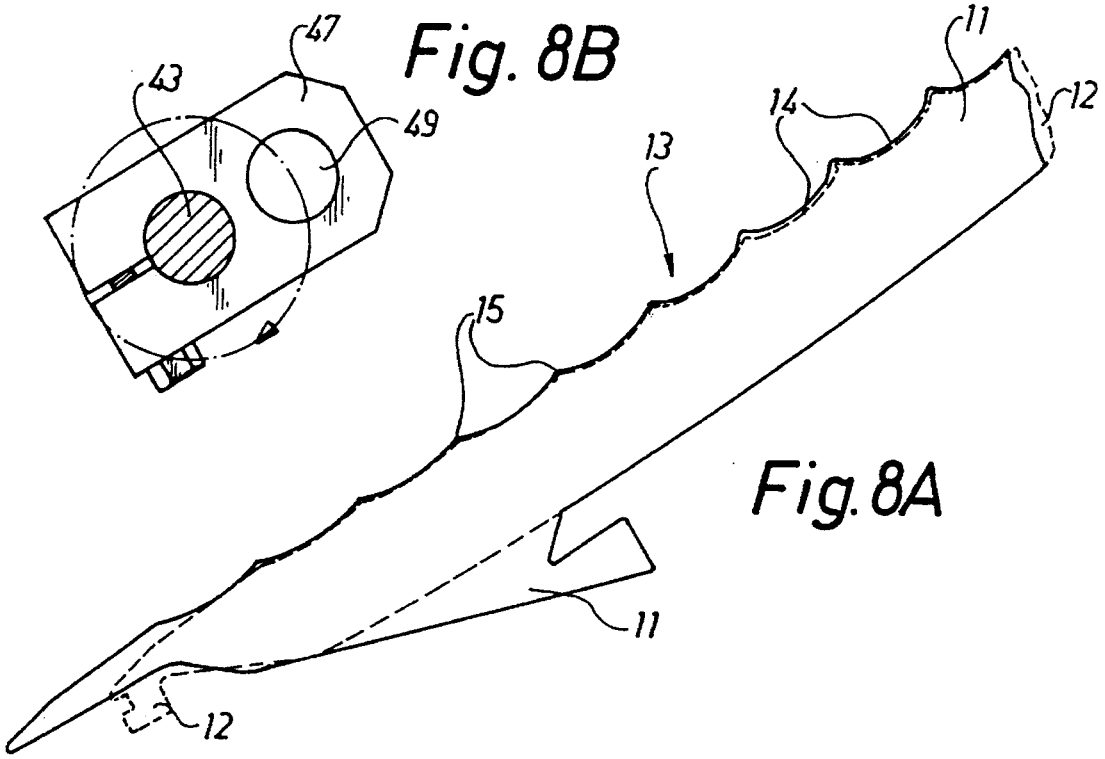
Fig. 8B
47
43
49
11
12
14
13
15
Fig. 8A
11
12
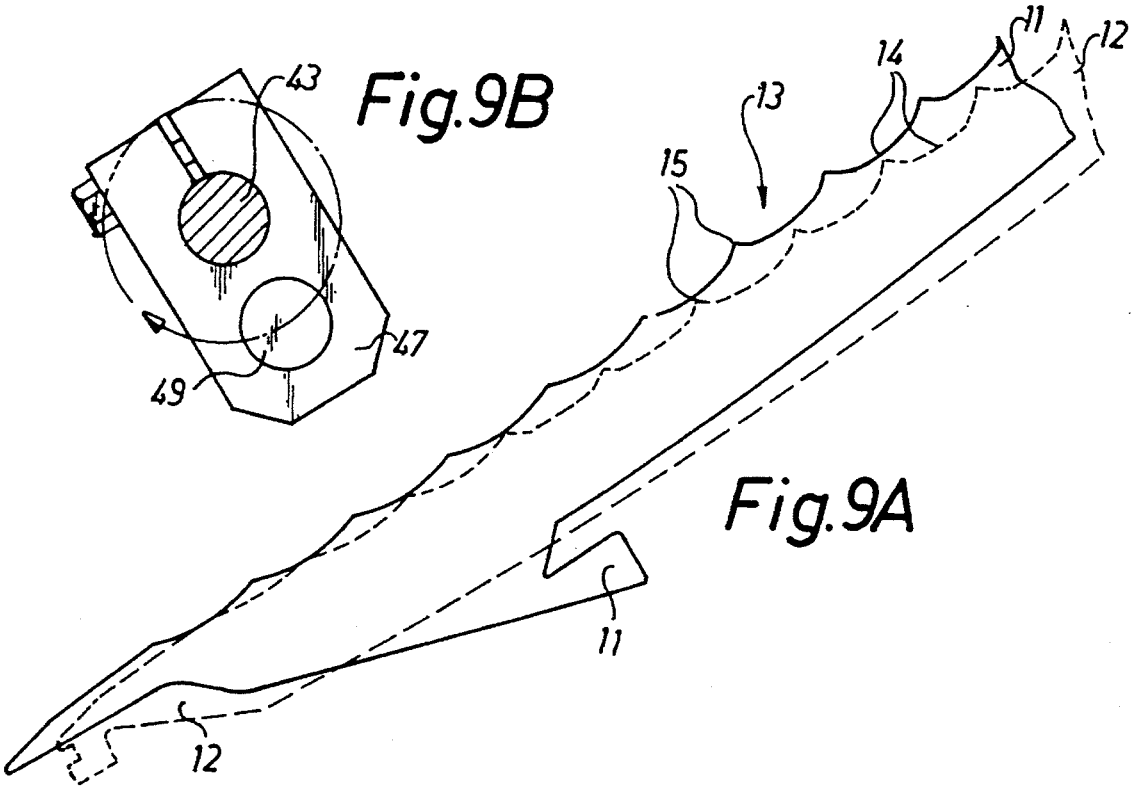
Fig. 9B
43
47
49
11
12
14
13
15
Fig. 9A
11
12

SEPARATING GRID

The subject invention relates to an improved separating device for collection and removal of solid particles and objects present in running water, the separating device being positioned in a channel through which the running water flows and having a stand supporting a separating unit arranged in a position of inclination obliquely rearwards, as seen in the direction of flow of the water, and comprising upended separating grid bars positioned side by side, of which fixed bars alternate with mobile bars, the bars having collection and removal means on their edges turned towards the direction of flow of the water, the fixed separating grid bars being fixedly connected to the stand whereas the mobile separating grid bars are movably connected thereto and arranged to be actuated by a drive unit in order to carry the solid particles and objects step by step upwards by means of their collection and removal means, out of the running water and along the collection and removal means of the fixed separating grid bars, up to an outlet from which the solid particles and objects thus collected are removed.

BACKGROUND OF THE INVENTION

In one prior-art separating grid of the kind outlined above, the collection and removal means of the fixed and mobile separating grid bars have a step-like configuration along the entire length of the bars, and the mobile separating grid bars are arranged to be actuated by a drive unit imparting to the mobile separating grid bars a closed path of movement in the plane of the grid bars, the vertical component of movement of which somewhat exceeds the height of the steps of the fixed grid bars.

In the prior-art separating grid, the mobile separating grid bars thus have a parallel displacement pattern similar to that of a draw-bar, i.e. all parts of the grid bars follow an identical circular path.

Because the lower ends of the mobile grid bars move vertically upwards and downwards to the same extent as forwards and backwards, it is very difficult to provide efficient sealing at the lower ends, particularly if one wishes to build a machine wherein the inter-bar spacing is smaller than the thickness of the separating grid bars. On account of the comparatively high velocity of the running water, solid particles and objects therefore will penetrate into the gaps between the fixed grid bars, which bars are left exposed as the lower ends of the mobile grid bars move vertically upwards with respect to said gaps.

The particles and objects that will fall through the grid entirely will be entrained by the running water, resulting in incomplete separation, with the result that further cleaning of the water will be required and/or that problems will be encountered in subsequent water-cleaning steps, with ensuing increase of costs and work.

The particles and objects that are so large, heavy, and/or hard that they are caught in the gaps between the fixed separating grid bars are hit by the lower edges of the mobile bars as the latter descend vertically into said gaps. The result is that these particles and objects, already stuck, will be forced further down into the gaps and finally clog the latter to a smaller or larger extent, or else, before this happens, the lower ends of the mobile grid bars may already have been deformed or made inoperative. Even if an increase of the grid bar dimensions were to make the bars more apt to withstand the stress to which they are exposed, the resistance would sooner or later reach such levels that the drive unit would no longer be capable of driving the mobile grid bars and come to a standstill, unless overload on the unit has already damaged it.

Irrespective of whether the mobile grid bars and the drive unit including the motion transmission mechanism associated therewith were to support the stress, the gaps between the fixed grid bars must be cleaned manually or with the aid of special equipment, of stuck or jamming particles and objects. This is a tedious and work-consuming job, in addition causing a more or less lengthy and serious shutdown. The situation is further aggravated if the grid bars or other components are damaged to such an extent that repairs and/or replacement of parts become necessary.

SUMMARY OF THE INVENTION

The object of the invention is to provide a separating device or grid of the kind defined in the introductory part wherein the drawbacks outlined in the aforegoing have been eliminated.

This object is achieved in accordance with the invention because the mobile grid bars are connected at their upper ends to the drive unit while the lower grid bar ends are guided by the stand, and because the drive unit imparts to the mobile grid bars a movement which at the upper ends thereof follows a closed path but which in a direction towards their lower ends follows successively and increasingly flattened ellipsical paths, and which at the lower grid bar ends follows an essentially rectilinear to-and-fro path.

BRIEF DESCRIPTION OF THE DRAWINGS

The invention will be described in closer detail in the following with reference to the accompanying drawings illustrating one particularly preferred although not restrictive embodiment.

FIGS. 3–5 illustrate schematically in lateral and partly sectionalized views detail components of the areas marked B, C, and D, respectively, in FIG. 1.

FIGS. 6A–9B illustrate schematically one cycle of the movement performed by the mobile grid bars incorporated in the separating grid in accordance with the invention.

Figure 1:
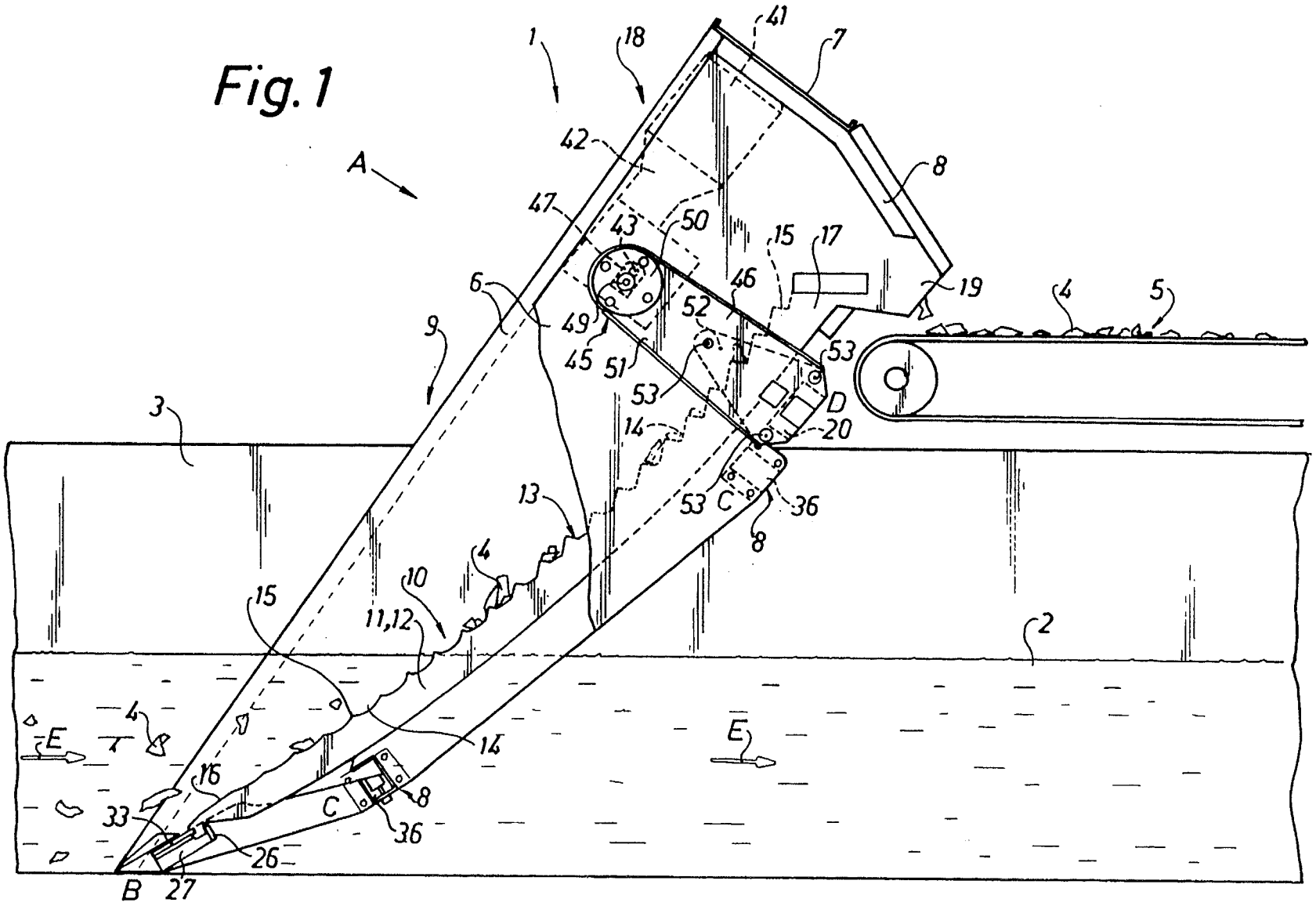
FIG. 1 is a schematical view from the side with some parts broken away, of a separating grid in accordance with the invention positioned in a channel of running water.

The separating grid designated generally by numeral 1 serves the function of collecting and transporting solid particles and objects.4 present in running water 2 flowing through a channel 3. The particles and objects 4 are discharged onto a conveyor 5 or similar device of suitable construction for removal.

The separating grid 1 has a stand 9 essentially consisting of side plates 6, end plates 7, and frame profile members 8. The side plates 6, the end plates 7 and advantageously also the frame profile members 8, preferably are made from a stainless material, such as stainless steel or some other material able to resist the effects of the running water 2 and its contents.

The side plates 6 of the stand 9 form the lateral delimiting and protecting walls of the separating grid 1 and they are configured in such a manner as to taper towards the lower end of the grid 1, which end is submerged in the running water 2, whereas the end plates 7 delimit the upper rear wall of the separating grid 1.

Intermediate its side plates 6 the stand 9 supports a separating unit, generally designated by 10, which like the stand 9 assumes an obliquely upwards and rearwards tilted position, as seen in the direction of flow E of the running water 2. The separating unit 10 comprises a number of fixed and mobile grid bars positioned side by side, the fixed grid bars 11 alternating with the mobile bars 12. The grid bars are upended and like the components making up the stand 9 they preferably are made from stainless steel or other water-resistant material.

In a manner to be described in closer detail hereinbelow the fixed grid bars 11 are secured to the stand 9 whereas in a manner likewise to be described in closer detail further on the mobile grid bars 12 are movably secured to the stand.

The number of fixed and mobile grid bars 11, 12 may be varied according to the desired width of the separating grid 1, and when the grids are very large, the grid bars may be arranged into one or several groups.

As seen from the side, the fixed as well as the mobile grid bars 11, 12 have a slightly depending arcuate configuration forming an angle to the horizontal plane that increases progressively from the bottom and upwards. On their upper edges turned towards the direction of flow E of the water 2 the bars are provided with collection and removal means 13. These means 13 are in the shape of depressions 14 and peaks 15 formed alternately in succession along essentially the entire length of the grid bars 11, 12, the depressions becoming deeper and the peaks higher and more pointed, as seen in the direction from the lower ends 16 of the grid bars 11, 12 to their upper ends 17. In other words, the depressions 14 and the peaks 15 are shallow and low, respectively, at the lower ends 16, in which area their configuration resembles that of small waves, and become increasingly more pronounced in the direction towards the upper grid bar ends 17, in which area they have a step-like configuration.

The mobile grid bars 12 of the collection and removal means 13 serve the purpose of carrying, when actuated by a drive unit 18 to be described in more detail hereinbelow the solid particles and objects 4 step by step upwards, out of the running water 2 and along the fixed grid bars 11, the latter being formed with identical collection and removal means 13, up to a discharge 19 positioned on the lower face of the upper end of the stand 9, upstream of the upper ends 17 of the grid bars 11, 12. From this discharge 19, the particles and the objects 4 are transferred onto the conveyor 5 or similar transportation means for removal.

To impart the desired movement to the mobile grid bars 12 the latter are connected to the drive unit 18 in the area of their upper ends 17 and in the area of their lower ends 16 they are guided by the stand 9.

More precisely, in the area of their upper ends 17 the mobile grid bars 12 are rigidly mounted on an upper movable cross beam 20, see FIGS. 1 and 5, in such a manner as to be individually removable. In accordance with the embodiment illustrated, the cross beam 20 is shaped as a box girder which is positioned underneath the mobile grid bars 12 and have upper and front recesses 21, 22 in which are removably received rearwardly and downwardly directed double hooks 23 formed on the mobile grid bars 12. In accordance with the embodiment illustrated, the double hooks 23 are secured in the recesses 21, 22 and consequently to the cross beam 20 because one of the double hooks is wedged in position by means of a profiled wedge 24 the tightening of which is effected by means of a tightening bolt 25.

In the area of their lower ends 16, the mobile grid bars 12 are more precisely secured to a lower cross piece 26, see FIGS. 1 and 3, so as to be individually removable. The cross piece 26 which is mounted in the stand 9 for controlled movements therein, extends between the side plates 6 and is formed with downwardly directed guide profile members 27 which are secured by fastening means, not shown, to the short ends of the plates or made integral therewith. Each one of said profile members 27 is formed with a longitudinal groove 28 in which a guide rail 30 of metal or other suitable material is mounted for controlled sliding movement therein. The rails 30 are secured to the stand by means of fasteners, for instance in the shape of bolts 29.

The cross piece 26 the movements of which thus are controlled as indicated, preferably is in the form of a shuttle plate of a primarily stainless material or other material that is resistant to the running water 2. The shuttle plate 26 is formed with upper recesses 31 in which downwardly and forwardly directed hooks formed at the lower ends 16 of the mobile grid bars are removably received. The hooks 32 are fastened in the recesses 31 by means of a covering plate 33, preferably of a plastics or other, similar material. The covering plate 33 is attached to the upper face of the shuttle plate 26 in some suitable manner, for instance by means of fasteners, such as screws or bolts, not shown in detail. A front lengthwise edge 34 of the covering plate 33 penetrates into grooves 35 formed in the lower ends 16 of the mobile grid bars 12 so as to secure the hooks 32 in engagement with the recesses 31.

In the area of their lower and upper ends 16, 17, the fixed grid bars 11 also are individually removably mounted on an upper and a lower fixed cross beam 36, see FIGS. 1 and 4, said fixed cross beams 36, which also form two of the frame profile members 8 of the stand 9, being in the shape of box girders. The box girders present front recesses 37 in which downwardly and rearwardly directed hooks 38 formed on the fixed grid bars 11 in the area of their lower and upper ends 16, 17 are removably received. The hooks 38 are secured in position in the recesses 37 with the aid of profiled wedges 39 clamping the hooks 38 against an inner face of the box girders with the aid of a tightening bolt or set bolt 40 or equivalent means.

The drive unit 18 referred to previously serves to impart a particular movement to the mobile grid bars 12. This movement, see FIGS. 3 and 6A-9B, follows a closed, essentially circular path in the area of the upper ends 17 of the mobile grid bars 12 and in the direction towards the lower ends 16 of the mobile grid bars the movement successively follows more and more flattened or compressed, elliptical paths and at their lower ends 16 the grid bar movement is an essentially rectilinear to and fro movement.

Figure 2:
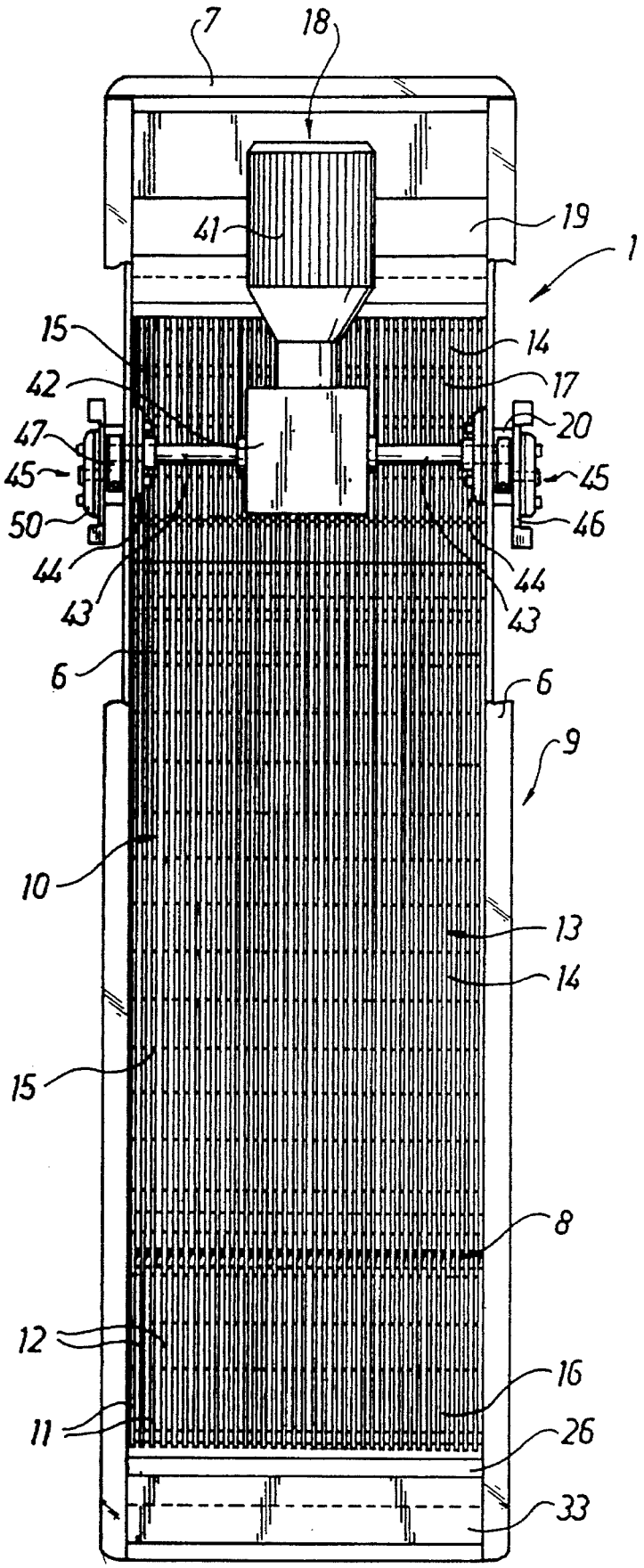
FIG. 2 illustrates the separating grid in accordance with FIG. 1 in a front view as seen in the direction of arrow A.

In order to produce this motion of the mobile grid bars 12, the drive unit 18 comprises a drive motor 41 which is mounted at the upper end of the stand 9, see FIGS. 1 and 2, and a gear box 42 mounted° thereon, comprising two coaxial and oppositely directed output drive shafts 43. The drive shafts 43 are rotationally mounted in bearings 44 on the side plates 6 of the stand and extend through said plates. Externally of the side plates 6 the drive shafts 43 actuate their respective one of two identical eccentric mechanisms 45 which via their individual follower means 46 associated with the upper mobile cross beam 20, impart the movement pattern referred to above to the mobile grid bars 12.

Each eccentric mechanism 45 has an eccentric arm 47, see FIGS. 1, 2 and 6A–9B, at one end of which is formed a recess 48 for attachment of the arm to the free end of the asociated output drive shaft 43, and presenting at its opposite end an eccentric pin 49. By means of a support 50 corresponding to the support 44 mounting the output drive shaft 43, the eccentric pin 49 is supported in the follower means 46 at the upper end thereof, the lower end of said follower means being attached to the upper mobile cross beam 20.

In accordance with the embodiment illustrated, each follower means 46 preferably is composed of two parts 51 and 52. Both parts 51, 52 preferably are made from sheet metal and one of them 51, serves to mount the eccentric pin 49 whereas the other one, 52, is securely connected to the upper mobile cross beam 20, for instance by being welded thereto. The parts 51, 52 are interconnected by means of a fastener 53 in the form of e.g. bolts which may be untightened and which after untightening allow the parts 51, 52 to be moved with respect to one another and consequently allow adjustment of the mutual positions of the fixed and mobile grid bars 11, 12 in order to provide the most efficient collection and removal of the solid particles and objects 4.

FIGS. 6A–9B illustrate schematically one cycle of the movement of the mobile grid bars 12 in relation to the fixed grid bars 11 in various angular positions of the eccentric arm 47.

In FIGS. 6A and 6B, the mobile grid bars 12 are in their "home position", i.e. in their lowermost position corresponding to the position in FIGS. 1 and 2 in which position the fixed and mobile grid bars and their respective depressions 14 and peaks 15 forming the collection and removal means 13, are in perfect registration with each other, side by side.

In FIGS. 7A and 7B, the mobile grid bars 12 are in a lifting phase wherein they lift and transfer, by one step, the solid particles and objects 4 resting on their collection and removal means 13, onto the subsequent collection and removal means 13 on the fixed grid bars.

In FIGS. 8A and 8B, the mobile grid bars 12 have reached their delivery phase, wherein they assume their uppermost position and deliver the particles and objects 4 onto the fixed grid bars 11.

In FIGS. 9A and 9B, finally, the mobile grid bars 12 are in their return phase towards "home position", wherein the collection and removal means 13 of the mobile grid bars are positioned below the corresponding means 13 on the fixed grid bars 11 in order not to interfere with the particles and solid objects resting thereon.

The invention must-not be considered to be limited to the preferred embodiment described above and illustrated in the drawings but could be modified in a variety of ways within the scope of the appended claims.

For example, the movement which in The area of the upper ends 17 of the mobile grid bars 12 follows a closed, essentially circular path, could instead follow a path of a different configuration, for instance a more or less elliptical or a rectangular path, etcetera.

I claim:

1. A separating grid (1) for collection and removal of solid particles and objects (4) present in running water (2), said water running through a channel (3) along a direction (E), said separating grid (1) being positioned in said channel, said separating grid (1) comprising a stand (9), said stand (9) supporting a separating unit (10) arranged in a position of inclination obliquely rearwardly with, respect to said direction of flow (E) of said water, said separating unit (10) comprising upended separating grid bars (11, 12) positioned side by side, wherein fixed bars (11) alternate with mobile bars (12), said grid bars (11, 12) having upper edges turned towards said direction of flow (E) of said water, said bars having collection and removal means (13) on said upper edges, the fixed separating grid bars (11) being fixedly connected to said stand (9), said mobile separating grid bars (12) being movably connected thereto, said separating unit further comprising a drive unit (18) and an outlet (19), said grid bars having upper ends (17) and lower ends (16), said drive unit (18) being located in the area of said upper ends (17) and being connected to said upper ends whereby upon actuation of said drive unit (18) said mobile grid bars (12) carry said solid particles and objects (4) step by step upwards by means of said collection and removal means (13) out of said running water (2) and along said collection and removal means (13) of said fixed separating grid bars (11), up to said outlet (19) from which the solid particles and objects (4) thus collected are removed, said lower ends (16) of said grid bars being guided by said stand (9), said drive unit (18) imparting to said mobile grid bars (12) a movement which at the upper ends (17) thereof follows a closed path and in the direction towards the lower grid bar ends (16) follows successively and increasingly flattened elliptical paths, and, at the lower grid bar ends, follows an essentially rectilinear to-and-fro path.

2. The separating grid according to claim 1 wherein said fixed grid bars (11) and said mobile grid bars (12) have a side and when seen from said side have a depending arcuate configuration forming an angle to the horizontal plane which increases progressively from the bottom and upwards.

3. The separating grid according to claim 1 wherein said collection and removal means on said fixed and mobile separating grid bars (11, 12) are in the shape of depressions (14) and peaks (15) formed alternately in succession along substantially the entire length of said grid bars (11,12), said depressions becoming deeper and said peaks higher and more pointed, as seen in the direction from said lower ends (16) of said grid bars (11, 12) to the upper ends (17) thereof.

4. The separating grid according to claim 1 which comprises an upper movable cross beam (20), a lower crosspiece (26) and wherein at said upper ends (17) thereof of said grid bars said mobile grid bars (12) are non-flexibly mounted on said upper movable cross beam (20) so as to be individually removable therefrom, and at the lower ends (16) thereof said mobile grid bars are mounted on said lower cross piece (26), so as to be individually removable therefrom, said cross piece (26) being mounted in said stand (9) for controlled movements therein, and wherein said drive unit (18) comprises a drive motor (41), at least one output drive shaft (43) and at least one eccentric mechanism (45), said drive motor (41) being mounted on said stand (9) by means of said at least one output drive shaft (43) driving said at least one eccentric mechanism (45), said mechanism imparting said movement to the mobile grid bars (12) by means a follower means (46) connected to said movable cross beam (20).

5. The separating grid according to claim 4 wherein said movable cross beam (20) is in the form of a box girder positioned under said mobile grid bars (12), said box girder having front recesses (21, 22), said movable grid bars having downwardly directed double hooks (23) formed at the upper ends (17) thereof, said hooks (23) being removably received in said recesses, said separating grid further comprising wedging means (24, 25) arranged to secure said hooks in position in said recesses.

6. The separating grid according to claim 4 which comprises guide rails (30), said guide rails (30) are secured to said stand, said cross piece (26) is mounted for controlled movements in said stand (9) and further comprises guide profile members (27), said members being mounted on said cross piece or made integral therewith, each member being formed with a groove (28), each of said guide rails (30) being engageable with its respective one of said guide profile members, said engagement ensuring said rectilinear to-and-fro movement of the lower ends (16) of said mobile grid bars (12).

7. The separating grid according to claim 4 which comprises a covering plate (33) of plastic material and said cross piece (26) is in the form of a shuttle plate (26) formed with upper recesses (31), said mobile grid bars (12) have downwardly directed hooks (32) at the lower ends (16) thereof, said hooks (32) being removably received in said recesses (31), said covering plate has an edge (34), said mobile grid bars (12) have grooves (35) at the lower ends (16) thereof, said shuttle plate has an upper face, said covering plate being secured to said upper face of said shuttle plate (26), said edge (34) projects into said grooves (35) in order to secure said hooks (32) in engagement with said recesses (31).

8. The separating grid according to claim 4 wherein said eccentric mechanism (45) comprises an eccentric arm (47), said arm having a recess (48) at one end thereof, for mounting said eccentric arm (47) on said output drive shaft (43), and an eccentric pin (49) at the opposite end thereof is provided, said follower means (46) having an upper end and an opposite end, said pin (49) being mounted at said upper end of said follower means (46) and said opposite end of said follower means being attached to said upper movable cross beam (20).

9. The separating grid according to claim 8 which comprises a fastener (53) and wherein said follower means (46) is composed of two parts (51, 52), said eccentric pin (49) is mounted into one part (51), the other part (52) being securely connected to said movable cross beam (20), said parts (51, 52) being interconnected by means of said fastener (53) which, when untightened, allows said parts (51, 52) to be moved with respect to one another whereby the mutual positions of said fixed and mobile grid bars (11, 12) are adjusted for the most efficient collection and removal of the said solid particles and objects (4).

10. The separating grid according to claim 9 which comprises lower and upper fixed cross beams (36) and wedging means (39, 40) and wherein said fixed grid bars (11) in the areas of said lower and upper ends (16, 17) have downwardly directed hooks (38) and in the areas of their lower and upper ends (16, 17) said fixed grid bars (11) are mounted on said respectively lower and upper fixed cross beams (36) so as to be individually removable, said cross beams (36) being mounted on said stand (9) and being in the shape of box girders, said box girders comprising front recesses (37), said downwardly directed hooks (38) being removably received into said recesses and being secured with the aid of said wedging means (39, 40).

* * * * *

UNITED STATES PATENT AND TRADEMARK OFFICE

CERTIFICATE OF CORRECTION

PATENT NO. : 5,456,826

DATED : October 10, 1995

INVENTOR(S) : Per Mellegard

It is certified that error appears in the above-identified patent and that said Letters Patent is hereby corrected as shown below:

On the title page, items [22], [86] and [87] were omitted from the patent.

| | | |
|---|---|---|
| [22] | PCT Filed: | May 29, 1992 |
| [86] | PCT No. | PCT/SE92/00365 |
| | § 371 Date: | Nov. 26, 1993 |
| | § 102(e) Date: | Dec. 13, 1993 |
| [87] | PCT Pub. No.: | WO92/21824 |
| | PCT Pub. Date: | Dec. 10, 1992 |

Signed and Sealed this

Twentieth Day of February, 1996

*Attest:*

*Attesting Officer*

Bruce Lehman

BRUCE LEHMAN

*Commissioner of Patents and Trademarks*